US005362338A

United States Patent [19]

Iwama et al.

[11] Patent Number: 5,362,338

[45] Date of Patent: Nov. 8, 1994

[54] NON-HEAT TREATING STEEL FOR HOT FORGING

[75] Inventors: Naoki Iwama, Chita; Ichie Nomura, Ichinomiya, both of Japan

[73] Assignee: Aichi Steel Works Ltd., Tokai, Japan

[21] Appl. No.: 26,095

[22] Filed: Mar. 4, 1993

Related U.S. Application Data

[63] Continuation of Ser. No. 736,648, Jul. 26, 1991, abandoned.

[30] Foreign Application Priority Data

Jul. 27, 1990 [JP] Japan ..... 2-199673
Sep. 28, 1990 [JP] Japan ..... 2-262588

[51] Int. Cl.[5] ..... C22C 38/00

[52] U.S. Cl. ..... 148/334; 148/506; 420/84; 420/104; 420/105

[58] Field of Search ..... 148/333, 334, 506; 420/84, 104, 105

[56] References Cited

U.S. PATENT DOCUMENTS

| | | | |
|---|---|---|---|
| 2,770,563 | 11/1956 | Herzog | 148/334 |
| 3,489,620 | 1/1970 | Current | 148/334 |
| 3,708,280 | 1/1973 | Mimino et al. | 148/334 |
| 3,970,483 | 7/1976 | Spaeder | 148/334 |

FOREIGN PATENT DOCUMENTS

| | | | |
|---|---|---|---|
| 50-97517 | 8/1975 | Japan . | |
| 56-38448 | 4/1981 | Japan . | |
| 58-167751 | 10/1983 | Japan . | |
| 204159 | 11/1983 | Japan | 148/334 |
| 59-100256 | 6/1984 | Japan . | |
| 60-50148 | 3/1985 | Japan . | |
| 61-238941 | 10/1986 | Japan . | |
| 62-196359 | 8/1987 | Japan . | |
| 62-205245 | 9/1987 | Japan . | |
| 62-253754 | 11/1987 | Japan . | |
| 62-260042 | 11/1987 | Japan . | |
| 1177338 | 7/1989 | Japan . | |
| 331416 | 2/1991 | Japan . | |
| 694557 | 10/1979 | U.S.S.R. | 148/334 |

*Primary Examiner*—Richard O. Dean
*Assistant Examiner*—Sikyin Ip
*Attorney, Agent, or Firm*—Oblon, Spivak, McClelland, Maier & Neustadt

[57] ABSTRACT

A non-heat-treating steel for hot forging which does not require heat treatment and still yields high static strength, toughness and fatigue resistance only by air cooling after hot forging. The main ingredients are, by weight %, 0.10–0.30% C, 0.05–0.50% Si, 0.80–2.00% Mn, 0.30–1.50% Cr, 0.05–0.50% Mo, 0.002–0.060% Al, 0.05–0.50% V, 0.008–0,020% N, and the balance Fe and inevitable impurities, where contents of some component elements should satisfy the following conditions, $$\%Mo+\%V \geqq 0.20(\%),$$

$$1.8\times\%Mn+\%Cr+0.5\times\%Mo \leqq 20\times\%C, \text{ and}$$

$$Bs \geqq 550(^{\circ}C.)$$

where Bs represents the bainite transformation temperature and is defined by $Bs=830-270\times C\%-90\times Mn\%-70\times Cr\%-83\times Mo\%$. Since the mechanical properties are obtained through air cooling, the mechanical properties are stable albeit the size of the forged article and the forging conditions. The non-heat-treating steel is especially suited for use in chassis parts of automobiles and hydraulic parts of construction machines.

12 Claims, No Drawings

NON-HEAT TREATING STEEL FOR HOT FORGING

This application is a continuation of application Ser. No. 07/736,648, filed on Jul. 26, 1991, now abandoned.

The present invention relates to a non-heat-treating steel which is mainly used for hot forged parts.

BACKGROUND OF THE INVENTION

Chassis parts of automobiles, such as a steering knuckle and suspension upper arms, and hydraulic parts of construction machines, such as a piston rod end, require both high strength and high toughness. Conventionally, in order to meet such mechanical requirements, those parts are made of middle carbon steels such as JIS-S43C, S45C, S48C, etc. (roughly they correspond to SAE 1042, 1045, 1049 steels), and, after hot forging, they are heat treated; i.e., heated, quenched (hardened) and reheated for tempering. The heat treatment should be carefully performed or, without appropriate heat treatment, these steels cannot exhibit proper performances.

One problem about the conventional heat-treatment middle carbon steels is that complete heat treatment is impossible for parts having a large mass (or a large cross section); parts having a cross sectional area larger than 10,000 $mm^2$ cannot be thoroughly quenched (hardened) to the core. Thus neither high strength nor high toughness can be obtained for such large parts.

Another and more serious problem about the heat-treatment steels is that the heat treatment consumes a large amount of energy. Recent social demand for less energy consumption has urged the development of so-called non-heat-treating steels which can provide mechanical properties required to such parts with only air cooling after they are shaped by hot forging. A typical non-heat-treating steel is a middle carbon steel with carbon content of 0.20–0.50% and vanadium content of 0.03–0.20%. When the steel is air cooled after hot forging, fine carbo-nitrides of vanadium precipitate in the ferrite matrix, which strengthen the ferrite matrix without later heat treatment.

The prior art non-heat-treating steels have strength comparable to heat-treated middle carbon steels. But the toughness is not comparable to heat-treated steels because the microstructure is coarse ferrite-pearlite when they are air cooled after hot forging. Another problem of the prior art non-heat-treating steels is that the requirements of hot forging conditions (e.g., heating temperature before forging, forging temperature, cooling speed after forging, etc.) are rather strict to obtain proper mechanical properties. Thus rather tedious preliminary tests are indispensable to determine an appropriate forging condition, and, when the forging starts, the forging conditions should be carefully controlled from time to time.

Further development in this field is a low-carbon bainitic non-heat-treating steel. It has high toughness. But its yield ratio and endurance ratio (i.e., the ratio of fatigue strength to the tensile strength) are low, so that the steel should be used at high strength to obtain adequate yield strength and fatigue strength. The high strength naturally leads to poorer forgeability and machinability which hampers its application to such parts as cited above.

SUMMARY OF THE INVENTION

Through intensive research on the non-heat-treating steels, especially on the bainitic non-heat-treating steels, the inventors of the present invention have found that the low yield ratio and low endurance ratio of the bainitic non-heat-treating steel are caused by:

a) high-carbon martensite and residual untransformed austenite grains scattering in the bainite matrix (these are referred to as M-A hereafter), and b) the residual transformation strain in the microstructure due to low transformation temperature.

Then the inventors of the present invention have introduced a formula among principal chemical components (i.e., C, Mn, Cr, Mo) of the bainitic steel representing the transformation temperature Bs. The amount of M-A and transformation strain can be decreased by restricting the lower limit of the transformation temperature to a certain value, i.e., by restricting contents of various elements appears in the formula, whereby the yield ratio and the endurance ratio are improved.

Further, it is found, the toughness is remarkably improved by an addition of both Mo and V, which make very fine bainite laths.

It is well known that finer (austenitic) grains bring about higher toughness. The inventors of the present invention have learned that, for Ti containing steels, a proper confinement of Al, Ti and N contents makes the grain size finer and the toughness is further improved.

Based on the knowledge above, the non-heat-treating steel of the present invention is designed.

DETAILED DESCRIPTION OF THE INVENTION

Basic and first embodiment of the present invention is a non-heat-treating steel for hot forging consisting essentially of (in weight percentage): 0.10–0.30% C, 0.05–0.50% Si, 0.80–2.00% Mn, 0.30–1.50% Cr, 0.05–0.50% Mo, 0.002–0.060% Al, 0.05–0.50% V, 0.008–0.020% N, and the balance Fe and inevitable impurities. Here, weight percentage of some of the elements should satisfy the following formulae:

$$\%Mo+\%V \geqq 0.20(\%),$$

$$1.8\times\%Mn+\%Cr+0.5\times\%Mo \leqq 20\times\%C, \text{ and}$$

$$Bs \geqq 550(^\circ C.),$$

where $$Bs=830-270\times\%C-90\times\%Mn-70\times\%Cr-83\times\%Mo.$$

Second embodiment of the present invention is concerned with an improved machinability, where one or more elements selected from the group consisting of 0.04–0.12% S, 0.05–0.30% Pb and 0.0005–0.01% Ca are further included in the steel of the first embodiment.

Third and fourth embodiments of the present invention are steels further including either one or both of 0.005–0.030% Ti and 0.01–0.30% Nb to the first and second embodiments to make the grains finer and improve toughness.

Fifth and sixth embodiments of the present invention have a more restricted range of Al, Ti and N in order to make the grains much finer and obtain higher toughness. That is, the following formulae should be satisfied:

$\%Al/27 < \%N/14$, and $\%Ti/\%N < 1.4$.

The following is the reason why the range of contents and the formulae described above are specified.

C:0.10–0.30%

Carbon should be included at least 0.10% to produce sufficient strength for such mechanical parts as described above. But carbon content in excess of 0.30% deteriorates toughness of the steels. A preferable upper limit is 0.28%.

Si:0.05–0.50%

Silicon should be included at least 0.05% to effectively function as deoxidizer in steel making. But silicon content in excess of 0.50% also deteriorates toughness of the steels.

Mn:0.80–2.00%

Manganese is one of the important elements in obtaining enough hardenability and making the bainitic microstructure by the air cooling after forging. Manganese content less than 0.80% cannot produce adequate bainitic microstructure and neither strength nor toughness will be obtained. But when the manganese content exceeds 2.00%, the hardenability is enhanced too much and M-A emerges in the microstructure, leading to poorer yield ratio and poorer endurance ratio.

Cr:0.30–1.50%

Chromium also produces bainitic microstructure, and chromium content less than 0.30% cannot produce sufficient bainitic microstructure as addressed by the invention. But chromium content in excess of 1.50% also produces M-A microstructure and deteriorates yield ratio and endurance ratio. A preferred lower limit of chromium content is 0.35%.

Mo:0.05–0.50%

Molybdenum, besides producing bainitic microstructure, makes the bainite lath finer and improves toughness. Molybdenum content less than 0.05% is insufficient for such purposes, but such effect saturates for molybdenum in excess of 0.50%. The excessive addition of molybdenum only increases the alloying cost and also produces M-A, decreasing the yield ratio and endurance ratio. A preferred lower limit is 0.08%.

A1:0.002–0.060%

Aluminum is a strong deoxidizer in steel making and at least 0.002% aluminum content is necessary for such purpose. But the deoxidizing effect saturates for aluminum content in excess of 0.060%, and the excessive aluminum content deteriorates machinability.

V:0.05–0.50%

Vanadium has a strong affinity with carbon and nitrogen and produces fine vanadium carbo-nitride precipitations in the steel. When primary ferrite precipitates in cooling the steel, the fine vanadium carbo-nitride precipitations strengthen the ferrite, and make bainite laths fine, improving the toughness of the steel. Vanadium content less than 0.05% lacks such effect, but in excess of 0.50% does not enhance the effect any more and only increases the alloy cost.

N:0.008–0.020%

Nitrogen has a strong affinity with aluminum, niobium and titanium. Fine carbo-nitrides of those elements precipitate in the steel and pins austenite grain boundaries, making fine grains and improving toughness of the steel. Nitrogen content not less than 0.008% is necessary to produce such effect, but that in excess of 0.020% deteriorates toughness on the contrary.

$\%Mo + \%V \geqq 0.20(\%)$

When both molybdenum and vanadium are included together, they retard the diffusion of carbon in the steel and impede the growth of bainite laths, making the bainite laths finer. Such effect is not obtained for $(\%Mo + \%V)$ less than 0.20(%).

$1.8 \times \%Mn + \%Cr + 0.5 \times \%Mo \leqq 20 \times \%C$

This formula is a necessary condition for suppressing the amount of M-A to less than 1% in the bainitic microstructure and make cementite precipitations fine. When manganese, chromium and molybdenum are excessively included to become $1.8 \times \%Mn + \%Cr + 0.5 \times \%Mo > 20C$, the amount of cementite precipitations decreases while that of M-A increases, whereby the yield ratio and endurance ratio decrease.

$Bs \geqq 550°\ C.$, where $Bs = 830 - 270 \times \%C - 90 \times \%Mn - 70 \times \%Cr - 83 \times \%Mo$ Bs represents the starting temperature of the bainite transformation. The higher Bs rises, the smaller the transformation strain becomes, and vice versa. As described above, the transformation strain lowers the yield ratio and endurance ratio. It is revealed that the amount of transformation strain remarkably increases as Bs becomes lower than 550° C., and the yield ratio and endurance ratio greatly decreases.

S:0.04–0.12%, Pb:0.05–0.30%, Ca:0.0005–0.01%

Sulfur, lead and calcium improve machinability of steels. Thus they are included when better machinability is required in the present invention. For obtaining such effect, sulfur content of no less than 0.04%, lead content of no less than 0.05% or calcium content of no less than 0.0005% is necessary. But sulfur content of more than 0.12%, lead content of more than 0.30%, or calcium content of more than 0.01% does not enhance such effect any more, and the toughness of the steel deteriorates.

Ti:0.005–0.030%, Nb:0.01–0.30%

Titanium and niobium both precipitate as carbonitrides in the steel and pin austenite grain boundaries. The effect is stronger than aluminum or vanadium nitrides. Thus titanium and niobium are effective in improving the toughness. Such effect is not obtained with titanium content of less than 0.005% or niobium content of less than 0.01%, but the effect saturates for titanium content of more than 0.030% or niobium content of more than 0.30%, whereas only the alloy cost increases.

$\%Al/27 < \%N/14$

As already mentioned, titanium forms nitrides to pin austenite grain boundaries, and the pinning effect is stronger than aluminum nitrides. But, since aluminum has a stronger affinity with nitrogen, aluminum precedes titanium in combining with nitrogen when both titanium and aluminum exist. Thus, in order to obtain enough pinning effect of titanium nitrides, nitrogen content should be large enough compared to the aluminum content, which is represented by the above formula.

$\%Ti/\%N < 1.4$

The pinning effect of titanium nitrides (TIN) is most effective when the precipitations of the titanium nitrides are very fine. The average size of titanium nitrides depends on the ratio of Ti content to N content in the steel, and the above formula is a necessary condition to obtain very fine titanium nitrides.

DESCRIPTION OF THE EXAMPLES

Example steels of the present invention are tested with comparison steels and conventional steels, whose chemical compositions are listed in Table 1. Among the examples 1–27 of the present invention, steels 1–4 belong to the first embodiment, steels 5–9 belong to the second embodiment, steels 10–12 belong to the third embodiment, steels 13–18 belong to the fourth embodiment, steels 19–22 belong to the fifth embodiment, and steels 23–27 belong to the sixth embodiment. Steels 28–34 are comparisons and steels 35 and 36 are conventional steels, where steel 35 is a ferrite-pearlite type non-heat-treating steel, and steel 36 is the JIS-S45C steel.

Table 1 also shows values of $\%Mo+\%V$ and Bs ($=830-270\times\%C-90\times\%Mn-70\times\%Cr-83-\%Mo$), and results of the formulae ("Y" shows that the formula is satisfied and "N" shows the opposite):

$$1.8\times\%Mn+\%Cr+0.5\times\%Mo \leqq 20\times\%C \quad (1)$$

$$\%Al/27 < \%N/14 \quad (2)$$

$$\%Ti/\%N < 1.4 \quad (3)$$

Results of the formulae (2) and (3) are given only for steels containing titanium and not containing niobium.

All steels except steel 36 are hot rolled into 60 mm diameter bars. The bars are heated to 1250° C., and forged into 30 mm diameter bar at 1150° C., followed by natural cooling to the room temperature. As for the steel 36 (JIS-S45C), a hot rolled 30 mm diameter bar is heated to 880° C., quenched in oil, and tempered at 580° C.

The specimens thus obtained are inspected by microscope for the microstructure (F=ferrite, B=bainite, P=pearlite), bainite lath size, and the amount of M-A, and tested for the mechanical properties, such as 0.2%-proof stress, tensile strength, yield ratio, endurance ratio, notch toughness and machinability.

The bainite lath size is measured, in the microscopic field of magnification of ×1000, by the length parallel to the length of the specimen, and the average of measurements in 100 fields is adopted as the representative value of the steel.

The amount of M-A is measured by the point counting method using a scanning electron microscope with the magnification of ×5000, and the average of 100 field measurements is adopted as the representative value.

Tensile strength and 0.2%-proof stress are measured with the JIS-No.4 standard tensile test piece (diameter: 14 mm, gauge length: 50 mm). The loading speed of the tensile test is 1 mm/min. The notch toughness is measured with the JIS-No.3 (2 mm U-notch Charpy) standard impact test piece.

The endurance ratio is the ratio of endurance limit to the tensile strength. The endurance test is performed on the Ono rotary bending fatigue test machine, and the endurance limit is determined as the maximum stress enduring $10^7$ rotations.

Machinability is evaluated by the total drilling depth attained by a standard drill with a standard drilling condition. The standard drill is a straight shank Φ5 mm drill made of JIS-SKH51, and the standard drilling condition is: drilling speed at 1710 rpm, no lubrication and the thrust load at 75 kgf. Machinability of a sample steel is represented by an index number with the conventional steel 36 setting at 100.

The test results are listed in Table 2. As shown in Table 2, each of the comparison steels 28–34 has somewhat lower quality than the example steels 1–27 of the present invention.

Comparison steel 28, whose carbon content is higher than the upper limit specified by the present invention, has lower notch toughness and machinability index.

Comparison steels 29 and 30, containing lower Mn or Cr content than as specified by the present invention, gain too much hardenability and produce a large amount of M-A. Since they do not satisfy the formula (1) and the condition Bs≧550° C., they have low yield ratio and low endurance ratio.

Comparison steel 31, containing less Mo content and lower (%Mo+%V) value than as specified by the present invention, lacks sufficient tensile strength because bainite transformation is not completed but pearlite is partially produced. Further, the yield ratio, endurance ratio and notch toughness of steel 31 are all inferior to those of the example steels because the chemical composition does not satisfy the formula (1) and a larger amount of M-A and larger size of bainite laths are produced.

Comparison steel 32, containing lower vanadium content than as specified by the present invention, has a larger bainite lath size and thus lower endurance ratio and notch toughness than the example steels.

Each content of the comparison steels 33 and 34 falls in the range specified by the present invention, but the formula (1) is not satisfied in steel 33 and the condition Bs≧550° C. is not satisfied in steel 34. Thus both steels 33 and 34 have lower yield ratio and lower endurance ratio than the examples of the present invention.

Conventional ferrite-pearlite type non-heat-treating steel 35 has lower yield ratio, lower endurance ratio and lower notch toughness, and conventional heat-treating steel 36 (JIS-S45C) also exhibits lower yield ratio, lower endurance ratio and lower notch toughness because complete heat treatment is impossible due to lack of hardenability.

The example steels 1–27 of the present invention, by contrast, all have small bainite lath size and small amount of M-A (less than 1%). All of the example steels have mechanical properties of: 0.2%-proof stress no less than 54 kgf/mm$^2$, tensile strength no less than 75 kgf/mm$^2$, yield ratio no less than 0.71, endurance ratio no less than 0.51 and notch toughness no less than 16 kgf.m/cm$^2$. Such mechanical properties are superior to that of completely heat-treated carbon steel.

The example steels belonging to the second, fourth and sixth embodiments of the present invention show better machinability than the example steels belonging to the first, third and fifth embodiment of the present invention, without sacrificing such mechanical properties as described above, because of the addition of machinability enhancing elements.

Now the influence of forging condition on the mechanical properties of some of the example steels (steels 3, 6, 11, 13, 19 and 23) and a conventional steel (steel 35) is described. Bars having diameter of 60 mm of those steels are forged under three different conditions as tabulated below into 30 mm bars.

(A) Heating to 1150° C. and forging at 1050° C.

(B) Heating to 1250° C. and forging at 1150° C.

(C) Heating to 1350° C. and forging at 1250° C.

The forged bars are naturally cooled to the room temperature. JIS-No. 4 standard tensile test piece and JIS-No. 3 standard impact test piece are cut out from the forged bars and tensile strength, 0.2%-proof stress, and notch toughness are measured on the specimens. The test results and calculated yield ratio ([0.2%-proof stress]/[tensile strength]) are listed in Table 3.

Table 3 shows that, in the conventional ferrite-pearlite type non-heat-treating steel 35, the tensile strength and 0.2%-proof stress remarkably increases and the notch toughness sharply drops as the heating and forging temperature rise. By contrast, the mechanical properties of the example steels of the present invention are quite stable irrespective of the forging condition, and they develop excellent mechanical properties in any condition of the heating temperature or forging temperature.

Next the influence of the size of forged article on the mechanical properties is studied. Since change in the size of forged article corresponds to change in the cooling speed after forging when naturally cooled, the result is also read as the influence of the cooling speed. Bars having diameters of 200, 120 and 60 mm of steels 3, 6, 11, 13, 19, 23 and 35 are heated to 1250° C. and forged into 100, 60 and 30 mm diameter bars respectively. The forged bars are naturally cooled to the room temperature. The average cooling speed of the largest 100mm bar (i.e., the slowest cooling speed) between 800° to 650° C. is approximately 10° C./min, and that of the smallest 30mm bar (i.e., the fastest cooling speed) between 800° to 650° C. is approximately 40° C./min. Tensile strength, 0.2%-proof stress, and notch toughness are measured with the JIS-No. 4 standard tensile test piece and JIS-No. 3 standard impact test piece cut out from the center of the forged bars. Measured values and calculated yield ratio are listed in Table 4.

As shown in Table 4, mechanical properties of the example steels 3, 6, 11, 13, 19 and 23 of the present invention are stable irrespective of the change in the cooling speed after forging (i.e., the size of forged article), while tensile strength, 0.2%-proof stress and notch toughness of the conventional steel 35 (ferrite-pearlite type non-heat-treating steel) decrease as the cooling speed decreases (i.e., as the size of forged article becomes larger). Table 4 includes data of conventional steel 36 (JIS-S45C carbon steel) where test pieces are taken from a 100 mm diameter bar heated to 880° C., quenched in oil and tempered at 580° C. The data clearly show that complete hardening by heat treatment is impossible for a such large diameter bar (Φ100 mm), and the mechanical properties are consequently poor.

In summary, example steels of the present invention assuredly show excellent mechanical properties even with a loose control over forging conditions and cooling conditions. Thus, the non-heat-treating steel of the present invention is suitable for use in chassis parts of an automobile and hydraulic parts of construction machines, and saves a large amount of energy by eliminating energy-consuming heat treatment after forging.

TABLE 1

| | | Chemical Composition (wt. %) | | | | | | | | | | | | | Mo + | Form | Form | Form | Bs |
|---|---|---|---|---|---|---|---|---|---|---|---|---|---|---|---|---|---|---|---|
| | No | C | Si | Mn | Cr | Mo | Al | V | N | Ti | Nb | S | Pb | Ca | V | (1) | (2) | (3) | (°C.) |
| 1st | 1 | 0.12 | 0.28 | 1.05 | 0.34 | 0.18 | 0.028 | 0.33 | 0.0145 | | | | | | 0.51 | Y | — | — | 664 |
| EM- | 2 | 0.18 | 0.25 | 1.28 | 0.65 | 0.08 | 0.022 | 0.18 | 0.0122 | | | | | | 0.26 | Y | — | — | 614 |
| BODI- | 3 | 0.21 | 0.26 | 1.50 | 0.55 | 0.21 | 0.018 | 0.08 | 0.0160 | | | | | | 0.29 | Y | — | — | 582 |
| MENT | 4 | 0.27 | 0.18 | 1.63 | 0.70 | 0.09 | 0.015 | 0.21 | 0.0092 | | | | | | 0.30 | Y | — | — | 554 |
| 2nd | 5 | 0.17 | 0.14 | 1.38 | 0.33 | 0.20 | 0.027 | 0.15 | 0.0128 | | | 0.058 | | | 0.35 | Y | — | — | 620 |
| EM- | 6 | 0.13 | 0.25 | 1.01 | 0.41 | 0.10 | 0.025 | 0.16 | 0.0093 | | | | 0.19 | | 0.26 | Y | — | — | 667 |
| BODI- | 7 | 0.25 | 0.19 | 1.53 | 0.82 | 0.07 | 0.030 | 0.20 | 0.0155 | | | | | 0.008 | 0.27 | Y | — | — | 562 |
| MENT | 8 | 0.22 | 0.24 | 0.85 | 0.64 | 0.19 | 0.016 | 0.06 | 0.0153 | | | 0.102 | 0.24 | | 0.25 | Y | — | — | 634 |
| | 9 | 0.15 | 0.24 | 1.20 | 0.33 | 0.20 | 0.028 | 0.16 | 0.0164 | | | 0.055 | 0.10 | 0.003 | 0.36 | Y | — | — | 642 |
| 3rd | 10 | 0.26 | 0.48 | 0.82 | 1.32 | 0.11 | 0.032 | 0.14 | 0.0151 | 0.008 | | | | | 0.25 | Y | N | Y | 584 |
| EM- | 11 | 0.16 | 0.09 | 1.18 | 0.45 | 0.33 | 0.025 | 0.15 | 0.0183 | | 0.05 | | | | 0.48 | Y | — | — | 622 |
| BODI- | 12 | 0.20 | 0.20 | 1.25 | 0.53 | 0.16 | 0.028 | 0.08 | 0.0148 | 0.022 | 0.19 | | | | 0.24 | Y | — | — | 613 |
| MENT | | | | | | | | | | | | | | | | | | | |
| 4th | 13 | 0.28 | 0.10 | 1.81 | 0.32 | 0.18 | 0.033 | 0.10 | 0.0148 | 0.010 | | 0.055 | | | 0.28 | Y | N | Y | 554 |
| EM- | 14 | 0.11 | 0.40 | 0.92 | 0.41 | 0.25 | 0.019 | 0.29 | 0.0108 | | 0.08 | | 0.18 | | 0.54 | Y | — | — | 668 |
| BODI- | 15 | 0.21 | 0.19 | 1.29 | 0.77 | 0.23 | 0.027 | 0.08 | 0.0112 | 0.007 | 0.04 | | 0.18 | | 0.31 | Y | — | — | 584 |
| MENT | 16 | 0.22 | 0.08 | 1.47 | 0.55 | 0.19 | 0.022 | 0.17 | 0.0157 | | 0.12 | 0.050 | | 0.001 | 0.36 | Y | — | — | 584 |
| | 17 | 0.16 | 0.38 | 0.90 | 1.01 | 0.45 | 0.008 | 0.07 | 0.0179 | 0.008 | 0.06 | 0.049 | 0.08 | | 0.52 | Y | — | — | 598 |
| | 18 | 0.18 | 0.09 | 1.71 | 0.38 | 0.17 | 0.025 | 0.15 | 0.0144 | 0.015 | 0.05 | 0.098 | 0.09 | 0.007 | 0.32 | Y | — | — | 587 |
| 5th | 19 | 0.17 | 0.26 | 0.98 | 1.35 | 0.45 | 0.025 | 0.29 | 0.0154 | 0.016 | | | | | 0.74 | Y | Y | Y | 564 |
| EM- | 20 | 0.19 | 0.23 | 1.34 | 0.68 | 0.06 | 0.018 | 0.15 | 0.0133 | 0.008 | | | | | 0.21 | Y | Y | Y | 606 |
| BODI- | 21 | 0.22 | 0.24 | 1.55 | 0.49 | 0.22 | 0.024 | 0.07 | 0.0162 | 0.021 | | | | | 0.29 | Y | Y | Y | 579 |
| MENT | 22 | 0.27 | 0.17 | 1.69 | 0.60 | 0.08 | 0.012 | 0.19 | 0.0095 | 0.012 | | | | | 0.27 | Y | Y | Y | 556 |
| 6th | 23 | 0.29 | 0.48 | 0.83 | 1.28 | 0.14 | 0.005 | 0.12 | 0.0083 | 0.010 | | 0.045 | | | 0.26 | Y | Y | Y | 576 |
| EM- | 24 | 0.14 | 0.10 | 1.18 | 0.39 | 0.33 | 0.024 | 0.16 | 0.0145 | 0.017 | | | 0.22 | | 0.49 | Y | Y | Y | 631 |
| BODI- | 25 | 0.24 | 0.20 | 1.40 | 0.94 | 0.07 | 0.034 | 0.43 | 0.0189 | 0.025 | | | | 0.007 | 0.50 | Y | Y | Y | 568 |
| MENT | 26 | 0.20 | 0.30 | 1.06 | 1.13 | 0.18 | 0.014 | 0.32 | 0.0110 | 0.014 | | 0.105 | 0.13 | | 0.50 | Y | Y | Y | 587 |
| | 27 | 0.15 | 0.25 | 0.95 | 0.74 | 0.25 | 0.030 | 0.22 | 0.0169 | 0.023 | | 0.063 | 0.06 | 0.002 | 0.47 | Y | Y | Y | 631 |
| COM- | 28 | 0.35 | 0.15 | 1.50 | 0.43 | 0.22 | 0.028 | 0.08 | 0.0136 | | | | | | 0.30 | Y | — | — | 552 |
| PARI- | 29 | 0.21 | 0.24 | 2.10 | 0.71 | 0.08 | 0.031 | 0.12 | 0.0088 | | | | | | 0.20 | N | — | — | 528 |
| SONS | 30 | 0.14 | 0.22 | 1.24 | 1.63 | 0.25 | 0.015 | 0.11 | 0.0093 | | | | | | 0.36 | N | — | — | 546 |
| | 31 | 0.17 | 0.21 | 1.88 | 0.38 | 0.02 | 0.033 | 0.06 | 0.0165 | | | | | | 0.08 | N | — | — | 587 |
| | 32 | 0.16 | 0.39 | 1.52 | 0.32 | 0.18 | 0.022 | 0.01 | 0.0143 | | | | | | 0.19 | Y | — | — | 613 |
| | 33 | 0.12 | 0.14 | 1.80 | 0.75 | 0.21 | 0.031 | 0.08 | 0.0144 | | | | | | 0.30 | N | — | — | 566 |
| | 34 | 0.28 | 0.18 | 1.58 | 1.02 | 0.35 | 0.029 | 0.12 | 0.0098 | | | | | | 0.47 | Y | — | — | 512 |
| CON- | 35 | 0.29 | 0.26 | 1.25 | 0.28 | 0.01 | 0.033 | 0.12 | 0.0138 | | | | | | 0.01 | Y | — | — | 619 |

TABLE 1-continued

| | No | Chemical Composition (wt. %) C | Si | Mn | Cr | Mo | Al | V | N | Ti | Nb | S | Pb | Ca | Mo + V | Form (1) | Form (2) | Form (3) | Bs (°C.) |
|---|---|---|---|---|---|---|---|---|---|---|---|---|---|---|---|---|---|---|---|
| VEN-TION-ALS | 36 | 0.44 | 0.23 | 0.76 | 0.12 | 0.01 | 0.028 | | 0.0083 | | | | | | 0.01 | Y | — | — | 634 |

TABLE 2

| | No | Microstructure | Bainite Lath size (μm) | M-A Content (%) | 0.2%-prf. Stress (kgf/mm²) | Tensile Strength (kgf/mm²) | Yield Ratio (%) | Endurance Ratio (%) | Notch Toughness (kgf · m/cm²) | Machin-ability Index |
|---|---|---|---|---|---|---|---|---|---|---|
| 1st | 1 | F + B | 8 | 0.5 | 54.6 | 75.8 | 0.72 | 0.52 | 21.3 | 118 |
| EMBODIMENT | 2 | F + B | 16 | 0 | 57.6 | 77.9 | 0.74 | 0.53 | 19.5 | 109 |
| | 3 | F + B | 15 | 0 | 59.6 | 79.5 | 0.75 | 0.53 | 19.3 | 100 |
| | 4 | B | 15 | 1.0 | 61.5 | 85.4 | 0.72 | 0.51 | 16.8 | 103 |
| 2nd | 5 | F + B | 14 | 0 | 56.4 | 77.2 | 0.73 | 0.53 | 18.4 | 158 |
| EMBODIMENT | 6 | F + B | 15 | 0 | 55.9 | 75.6 | 0.74 | 0.53 | 19.0 | 164 |
| | 7 | B | 15 | 0.5 | 58.3 | 81.0 | 0.72 | 0.52 | 18.7 | 150 |
| | 8 | F + B | 15 | 0 | 57.5 | 78.7 | 0.73 | 0.52 | 20.6 | 188 |
| | 9 | F + B | 13 | 0 | 57.9 | 77.2 | 0.75 | 0.54 | 19.0 | 203 |
| 3rd | 10 | F + B | 17 | 0 | 64.1 | 84.3 | 0.76 | 0.54 | 23.8 | 102 |
| EMBODIMENT | 11 | B | 11 | 0 | 59.9 | 76.8 | 0.78 | 0.55 | 25.5 | 112 |
| | 12 | B | 16 | 0 | 61.7 | 78.1 | 0.79 | 0.56 | 28.1 | 105 |
| 4th | 13 | B | 14 | 1.0 | 61.3 | 86.3 | 0.71 | 0.51 | 20.1 | 141 |
| EMBODIMENT | 14 | B | 9 | 0 | 57.4 | 75.5 | 0.76 | 0.53 | 21.0 | 187 |
| | 15 | B | 12 | 0.5 | 60.5 | 78.6 | 0.77 | 0.54 | 22.2 | 176 |
| | 16 | B | 12 | 0.5 | 58.7 | 79.3 | 0.74 | 0.53 | 21.9 | 191 |
| | 17 | B | 10 | 0 | 58.5 | 77.0 | 0.76 | 0.54 | 20.3 | 199 |
| | 18 | B | 11 | 1.0 | 58.6 | 78.1 | 0.75 | 0.53 | 20.7 | 215 |
| 5th | 19 | B | 7 | 0.5 | 62.4 | 82.0 | 0.76 | 0.52 | 24.2 | 106 |
| EMBODIMENT | 20 | F + B | 15 | 0 | 58.7 | 76.8 | 0.76 | 0.52 | 24.8 | 118 |
| | 21 | F + B | 13 | 0 | 61.8 | 78.4 | 0.79 | 0.54 | 25.4 | 108 |
| | 22 | F + B | 14 | 0 | 64.1 | 82.5 | 0.78 | 0.52 | 23.9 | 100 |
| 6th | 23 | F + B | 14 | 0 | 60.0 | 79.1 | 0.76 | 0.53 | 24.3 | 151 |
| EMBODIMENT | 24 | F + B | 10 | 0 | 61.1 | 77.2 | 0.79 | 0.53 | 25.5 | 163 |
| | 25 | F + B | 9 | 0 | 62.6 | 79.3 | 0.79 | 0.51 | 24.7 | 142 |
| | 26 | B | 9 | 0 | 60.2 | 77.1 | 0.78 | 0.52 | 25.0 | 185 |
| | 27 | F + B | 10 | 0 | 58.4 | 75.7 | 0.77 | 0.51 | 26.1 | 204 |
| COMPARISONS | 28 | B | 18 | 0.5 | 68.0 | 93.2 | 0.73 | 0.51 | 3.5 | 87 |
| | 29 | B | 17 | 18.0 | 58.4 | 91.2 | 0.64 | 0.45 | 17.2 | 91 |
| | 30 | B | 12 | 13.0 | 51.9 | 79.9 | 0.65 | 0.46 | 18.4 | 105 |
| | 31 | F + P + B | 42 | 11.0 | 46.9 | 72.1 | 0.65 | 0.47 | 14.4 | 125 |
| | 32 | F + B | 51 | 0.5 | 53.4 | 75.2 | 0.71 | 0.48 | 8.6 | 112 |
| | 33 | B | 12 | 8.5 | 51.9 | 77.4 | 0.67 | 0.48 | 16.8 | 104 |
| | 34 | B | 10 | 1.0 | 62.1 | 94.1 | 0.66 | 0.46 | 15.6 | 89 |
| CONVEN-TIONALS | 35 | F + B | — | 0 | 55.9 | 81.0 | 0.69 | 0.47 | 8.0 | 104 |
| | 36 | Slack Hardened | — | 0 | 53.9 | 79.3 | 0.68 | 0.48 | 14.5 | 100 |

TABLE 3

| | No | *1 | Tensile Strength (kgf/mm²) | 0.2%-prf. Stress (kgf/mm²) | Yield Ratio | Notch Toughness (kgf · m/cm²) |
|---|---|---|---|---|---|---|
| 1st | 3 | A | 79.5 | 59.5 | 0.75 | 18.6 |
| EMBODI- | | B | 79.5 | 59.6 | 0.75 | 19.3 |
| MENT | | C | 79.6 | 59.7 | 0.75 | 19.2 |
| 2nd | 6 | A | 75.6 | 55.9 | 0.74 | 18.3 |
| EMBODI- | | B | 75.6 | 55.9 | 0.74 | 19.0 |
| MENT | | C | 75.6 | 56.0 | 0.74 | 18.2 |
| 3rd | 11 | A | 76.8 | 60.1 | 0.78 | 25.3 |
| EMBODI- | | B | 76.8 | 59.9 | 0.78 | 25.5 |
| MENT | | C | 77.0 | 60.0 | 0.78 | 25.2 |
| 4th | 13 | A | 85.7 | 61.2 | 0.71 | 19.8 |
| EMBODI- | | B | 86.3 | 61.3 | 0.71 | 20.1 |
| MENT | | C | 86.5 | 61.5 | 0.71 | 19.9 |
| 5th | 19 | A | 81.7 | 62.3 | 0.76 | 24.5 |
| EMBODI- | | B | 82.0 | 62.4 | 0.76 | 24.2 |
| MENT | | C | 81.9 | 62.3 | 0.76 | 24.7 |
| 6th | 23 | A | 79.5 | 60.4 | 0.76 | 24.6 |
| EMBODI- | | B | 79.1 | 60.0 | 0.76 | 24.3 |
| MENT | | C | 79.2 | 60.3 | 0.76 | 24.4 |
| CONVEN- | 35 | A | 76.0 | 50.6 | 0.67 | 12.4 |
| TIONAL | | B | 81.0 | 55.9 | 0.69 | 8.0 |

TABLE 3-continued

| | No | *1 | Tensile Strength (kgf/mm²) | 0.2%-prf. Stress (kgf/mm²) | Yield Ratio | Notch Toughness (kgf · m/cm²) |
|---|---|---|---|---|---|---|
| | | C | 84.8 | 59.4 | 0.70 | 1.9 |

*1: Forging Condition
A: Heating to 1150° C. Forging at 1050° C.
B: Heating to 1250° C. Forging at 1150° C.
C: Heating to 1350° C. Forging at 1250° C.

TABLE 4

| | No | *2 | Tensile Strength (kgf/mm²) | 0.2%-prf. Stress (kgf/mm²) | Yield Ratio | Notch Toughness (kgf · m/cm²) |
|---|---|---|---|---|---|---|
| 1st | 3 | D | 79.6 | 59.6 | 0.75 | 19.3 |
| EMBODI- | | E | 79.6 | 59.6 | 0.75 | 19.1 |
| MENT | | F | 79.2 | 59.4 | 0.75 | 19.1 |
| 2nd | 6 | D | 75.6 | 55.9 | 0.74 | 19.0 |
| EMBODI- | | E | 75.2 | 55.8 | 0.74 | 18.4 |
| MENT | | F | 75.1 | 55.7 | 0.74 | 18.3 |
| 3rd | 11 | D | 76.8 | 59.9 | 0.78 | 25.5 |
| EMBODI- | | E | 76.5 | 59.8 | 0.78 | 25.3 |
| MENT | | F | 76.5 | 59.8 | 0.78 | 25.2 |
| 4th | 13 | D | 86.3 | 61.3 | 0.71 | 20.1 |

TABLE 4-continued

| | No | *2 | Tensile Strength (kgf/mm²) | 0.2%-prf. Stress (kgf/mm²) | Yield Ratio | Notch Toughness (kgf · m/cm²) |
|---|---|---|---|---|---|---|
| EMBODI- | | E | 86.0 | 61.1 | 0.71 | 19.7 |
| MENT | | F | 85.6 | 61.1 | 0.71 | 20.1 |
| 5th | 19 | D | 82.0 | 62.4 | 0.76 | 24.2 |
| EMBODI- | | E | 81.8 | 62.4 | 0.76 | 24.6 |
| MENT | | F | 81.7 | 62.3 | 0.76 | 24.5 |
| 6th | 23 | D | 79.1 | 60.0 | 0.76 | 24.3 |
| EMBODI- | | E | 79.2 | 60.4 | 0.76 | 24.1 |
| MENT | | F | 79.3 | 60.3 | 0.76 | 24.2 |
| CONVEN- | 35 | D | 81.0 | 55.9 | 0.69 | 8.0 |
| TIONAL | | E | 78.5 | 54.1 | 0.69 | 5.1 |
| | | F | 73.0 | 49.4 | 0.68 | 2.1 |
| | 36 | F | 69.9 | 47.8 | 0.68 | 12.7 |

*2: Finished Bar Diameter
D: Bar Diameter $\phi$30 mm
E: Bar Diameter $\phi$60 mm
F: Bar Diameter $\phi$100 mm

What is claimed is:

1. Non-heat-treating steel used after being heated, hot-forged and air cooled, consisting essentially of, by weight %,
0.10–0.30% C,
0.05–0.50% Si,
0.80–2.00% Mn,
0.30–1.50% Cr,
0.07–0.50% Mo,
0.015–0.060% Al,
0.07–0.50% V,
0.0108–0.020% N,
and the balance Fe and inevitable impurities, wherein $$\%Mo+\%V \geqq 0.20(\%),$$

$$1.8\times\%Mn+\%Cr+0.5\times\%Mo \leqq 20\times\%C, \text{ and}$$

$$Bs \geqq 550(°C)$$

in which $$Bs=830-270\times C\%-90XMn\%-70\times Cr\%-83\times Mo\%.$$

2. Non-heat-treating steel according to claim 1, wherein the steel further comprises, by weight %, one or more elements selected from the group consisting of
0.04–0.12% S,
0.05–0.30% Pb, and
0.0005–0.01% Ca.

3. Non-heat-treating steel according to claim 1, wherein the steel further comprises, by weight %,
0.01–0.30% Nb.

4. Non-heat-treating steel according to claim 2, wherein the steel further comprises, by weight %,
0.01–0.30% Nb.

5. Non-heat-treating steel used after being heated, hot-forged and air cooled, consisting essentially of, by weight %,
0.10–0.30%C,
0.05–0.50% Si,
0.80–2.00% Mn,
0.30–1.50% Cr,
0.07–0.50% Mo,
0.015–0.060% Al,
0.07–0.50% V,
0.0108–0.020% N,
and the balance Fe and inevitable impurities, wherein $$\%Mo+\%V \geqq 0.20(\%),$$

$$1.8X\%Mn+\%Cr+0.5\times\%Mo \leqq 20\times\%C,$$

$$Bs \geqq 550(°C.)$$

in which
$Bs=830-270\times C\%-90\times Mn\%-70\times Cr\%-83\times Mo\%$, $\%Al/27<\%N/14$.

6. Non-heat-treating steel according to claim 5, wherein the steel further comprises, by weight %, one or more elements selected from the group consisting of
0.04–0.12% S,
0.05–0.30% Pb, and
0.0005–0.01% Ca.

7. Non-heat-treating steel used after being heated, hot-forged and air cooled, consisting essentially of, by weight %,
0.10–0.28% C,
0.05–0.50% Si,
0.80–2.00% Mn,
0.35–0.50% Cr,
0.08–0.50% Mo,
0.015–0.060% Al,
0.07–0.50% V,
0.0108–0.020% N,
and the balance Fe and inevitable impurities, wherein $$\%Mo+\%V \geqq 0.20(\%),$$

$$1.8\times\%Mn+\%Cr+0.5\times\%Mo \leqq 20\times\%C, \text{ and}$$

$$Bs \geqq 550(°C)$$

in which $$Bs=830-270\times C\%-90XMn\%-70\times Cr\%-83\times Mo\%.$$

8. Non-heat-treating steel according to claim 7, wherein the steel further comprises, by weight %, one or more elements selected from the group consisting of
0.04–0.12% S,
0.05–0.30% Pb, and
0.0005–0.01% Ca.

9. Non-heat-treating steel according to claim 7, wherein the steel further comprises, by weight %,
0.01–0.30% Nb.

10. Non-heat-treating steel, consisting essentially of, by weight %,
0.10–0.30% C,
0.05–0.50% Si,
0.80–2.00% Mn,
0.30–1.50% Cr,
0.07–0.50% Mo,
0.015–0.060% Al,
0.07–0.50% V,
0.0108–0.020% N,
and the balance Fe and inevitable impurities, wherein $$\%Mo+\%V \geqq 0.20(\%),$$

$$1.8\times\%Mn+\%Cr+0.5\times\%Mo \leqq 20\times\%C, \text{ and}$$

$$Bs \geqq 550(°C)$$

in which $$Bs=830-270\times C\%-90XMn\%-70\times Cr\%-83\times Mo\%,$$

wherein the steel has been heated, hot-forged and air cooled.

11. Non-heat-treating steel, consisting essentially of, by weight %, 0.10–0.30%C,
0.05–0.50% Si,
0.80–2.00% Mn,
0.30–1.50% Cr,
0.07–0.50% Mo,
0.015–0.060% Al,
0.07–0.50% V,
0.0108–0.020% N, and the balance Fe and inevitable impurities, wherein $$\%Mo+\%V \geqq 0.20(\%),$$

$$1.8X\%Mn+\%Cr+0.5\times\%Mo \leqq 20\times\%C,$$

$$Bs \geqq 550(^{\circ}C)$$

in which $$Bs=830-270\times C\%-90\times Mn\%-70\times Cr\%-83\times Mo\%,$$

$$\%Al/27<\%N/14,$$

wherein the steel has been heated, hot-forged and air-cooled.

12. Non-heat-treating steel, consisting essentially of, by weight %, 0.10–0.28% C,
0.05–0.50% Si,
0.80–2.00% Mn,
0.35–0.50% Cr,
0.08–0.50% Mo,
0.015–0.060% Al,
0.07–0.50% V,
0.0108–0.020% N, and the balance and inevitable impurities, wherein $$\%Mo+\%V \geqq 0.20(\%),$$

$$1.8\times\%Mn+\%Cr+0.5\times\%Mo \leqq 20\times\%C, \text{ and}$$

$$Bs \geqq 550(^{\circ}C)$$

in which $$Bs=830-270\times C\%-90XMn\%-70\times Cr\%-83\times Mo\%,$$

wherein the steel has been heated, hot-forged and air-cooled.

* * * * *